United States Patent [19]

Sinclair

[11] 4,058,362

[45] Nov. 15, 1977

[54] PROTECTION OF METALS OR METAL CONTAINING ARTICLES

[75] Inventor: Robert A. Sinclair, St. Paul, Minn.

[73] Assignee: Minnesota Mining and Manufacturing Company, St. Paul, Minn.

[21] Appl. No.: 532,014

[22] Filed: Dec. 12, 1974

[30] Foreign Application Priority Data

Jan. 3, 1974 United Kingdom ..... 260/74

[51] Int. Cl.[2] ..... C23F 15/00; C09K 15/04

[52] U.S. Cl. ..... 21/2.5 R; 21/61; 55/387; 252/394; 252/395; 252/396

[58] Field of Search ..... 21/2.5 R, 61; 55/74, 55/387; 206/84; 252/394–396

[56] References Cited

U.S. PATENT DOCUMENTS

| | | | |
|---|---|---|---|
| 1,561,650 | 11/1925 | Lashar | 21/2.5 R X |
| 2,151,053 | 3/1939 | Solberg | 21/2.5 R X |
| 2,506,731 | 5/1950 | Moss | 21/2.5 R |
| 2,531,114 | 11/1950 | Dietz | 21/2.5 R |
| 2,950,295 | 8/1960 | Zimmer | 260/397.7 |
| 3,222,285 | 12/1965 | Rai et al. | 252/394 X |
| 3,306,862 | 2/1967 | Mageli et al. | 60/2.5 |
| 3,493,522 | 2/1970 | Webb | 260/2 |
| 3,503,883 | 3/1970 | Ford et al. | 21/2.5 R X |
| 3,780,500 | 12/1973 | Clemens et al. | 55/174 X |
| 3,793,076 | 2/1974 | Lea | 134/41 X |
| 3,816,355 | 6/1974 | Clemens | 55/74 X |
| 3,876,395 | 4/1975 | Cotter et al. | 55/74 X |

OTHER PUBLICATIONS

Gould, Edwin, Mechanism and Structure in Organic Chemistry, Holt, Rinehart & Winston, New York, N.Y., 1959, pp. 220 & 221.

Poshkus et al., "Studies on Nitroaniline–Sulfuric Acid Compositions: Aphrogenic Pyrostats," J. Applied Polymer Science, vol. 11, pp. 2049–2064, (1970).

*Primary Examiner*—Norman Yudkoff
*Assistant Examiner*—Barry I. Hollander
*Attorney, Agent, or Firm*—Cruzan Alexander; Donald M. Sell; Mark A. Litman

[57] ABSTRACT

A method and structure for protection of metals subject to corrosion by acidic gases. Metals are enclosed within an air-confining structure with a black sorbent thermoset foam, highly sorbtive of acidic vapors.

13 Claims, No Drawings

PROTECTION OF METALS OR METAL CONTAINING ARTICLES

This invention relates to the protection of metals or metal containing articles from atmospheric corrosion.

Many metals tend to tarnish quite rapidly when exposed to the atmosphere and generally it is the presence of traces of acid materials, oxidizing materials, hydrogen sulphide and other sulphide compounds in the atmosphere which gives this tarnishing. Traces of hydrogen sulphide and other sulphur compounds such as sulphur dioxide often pass into the atmosphere as a result of the combustion of fuels such as coal and oil.

The tarnishing or corrosion of silver, for example, is apparent when silver articles such as silverware are left on display. When silver contacts are used in electrical relays, tarnishing or corrosion of them can lead to inefficient switching by the relay. In telephone exchanges where there may be many thousands of such relays, the failure or inefficient working of just one or two such relays can be very serious. Further, the silver in developed photographic images can become tarnished with time and so the definition of the silver image reduced. Copper used in valuable coins is also readily subject to corrosion by atmospheric corrosives.

In these and other ways it can be seen that this tarnishing or corrosion of metal is highly undesirable and so it is an object of this invention to provide a method of avoiding or reducing this tarnishing or corrosion of metal.

According to the invention there is provided an enclosure containing a metal, metal-containing or metal-coated item (which metal is subject to corrosion or tarnishing) in which enclosure the atmosphere is or has been in contact with a particular class of sorbent for corrosion or tarnishing atmospheric components, the sorbent being a black thermoset foam which has been prepared by the pyrolysis of a liquid composition comprising at least one aromatic nitrogen-containing compound.

Also according to the invention there is provided a method of protecting a metal, metal-containing or metal-coated item from corrosion or tarnishing in which the item is maintained in a controlled atmosphere which is or has been in contact with black sorbent thermoset foam which has been prepared by the pyrolysis of a liquid composition comprising at least one aromatic nitrogen-containing compound.

Most particularly, the present invention relates to protection of silver, silver-containing and silver-coated items.

The sorbent thermoset foam used in the practice of the present invention are those materials disclosed in U.S. applications Ser. Nos. 469,102 and 471,579 (now U.S. Pat. No. 3,985,689), filed on May 13, 1974 and May 20, 1974 in the names of L. A. Errede et al. and A. N. Ferguson, respectively, which applications are herein incorporated by reference in their entirities for their disclosure of the nature of the foam sorbent and its method of manufacture.

These foams are made by the pyrolysis of at least one aromatic nitrogen containing compound having the formula:

$$X - Ar - Y$$

wherein Ar represents an aromatic nucleus on which X and Y are substituents directly attached to the nucleus, X representing a substituent having a negative Hammett sigma constant and attached to the aromatic nucleus by a nitrogen, oxygen, or sulfur atom, and Y represents a substituent having a positive Hammett sigma constant and attched to the aromatic nucleus by a nitrogen atom, the substituents X and/or Y optionally forming part of a ring fused into the aromatic nucleus, the sorbent thermoset foam having a specific surface area of at least 50 $m^2/g$.

These thermoset foams have been found to have a strong affinity for hydrogen sulphide, hydrogen chloride, organic acids, and other sulphur-containing pollutant gases in the atmosphere. Therefore the controlled atmosphere in which the silver item is maintained will be kept substantially free of any traces of such pollutants with the result that the silver item remains non-corroded or untarnished. The affinity of the thermoset foam for these pollutants is long lasting and so silver items can be protected in this way for long periods of time.

Silver plated relay contacts are usually kept in an enclosure which is not completely sealed from the outside atmosphere so as to allow the escape of small quantities of plasticizer and other organic compounds which may be slowly released by insulators and the like within the enclosure. Therefore traces of atmospheric contaminations such as hydrogen sulphide can enter and cause corrosion of the contacts. Silver within these enclosures may be protected in the practice of this invention.

In accordance with the invention an enclosure containing metal subject to acid corrosion additionally contains some of the thermoset foam which scavanges any traces of the pollutants from the enclosure. Also the foam does not release these sorbed traces of, for example, hydrogen sulphide and hydrogen chloride with time. Therefore the contacts remain untarnished and their switching reliability is much improved.

Not only does the foam sorb contaminants from the outside atmosphere such as hydrogen sulphide, but it will also sorb other polar molecules and therefore certain of the plasticizer and other organic molecules will be sorbed. This has the important additional advantage that many of these organic compounds are thought to cause some corrosion of the contacts or form an insulating layer on them leading to unsatisfactory switching.

In order to sorb most if not all volatile molecules it has been found that additionally some active charcoal which will absorb non-polar molecules can be incorporated in the enclosure. This active charcoal can be admixed with the sorbent thermoset foam, or separate pieces of each can both be incorporated in the enclosure.

Valuable silver, copper, or lead articles, or developed silver halide photographic materials can, in accordance with the invention, be kept in a container in a similar fashion to the relays together with some of the foam or any air entering the housing in which they are kept can be caused to pass in contact with some of the foam so as to remove these pollutants before they can harm the silver items.

Certain observations should be noted about the environment within which protection of the metal occurs. The structure of the enclosure should be sufficiently confining that air replacement under ambient or stable conditions does not occur more than about 20 times per day. This is desirable, as the corrosive materials in the air take some finite amount of time to be absorbed or adsorbed by the foam, and greater rates of replacement will not allow sufficient time for the corrosives to be removed. It is more preferred that complete air replacement within the enclosure not occur more than 10 times per day under stable conditions. By stable conditions is meant in the absence of any regular massive venting of the enclosure (as by opening or shutting cabinet doors), with no Bernoulli effects drawing gas out of the enclosure, or any other phenomenon beyond ambient mass exchange and mass flow into and out of the enclosure. Gas should not be able to freely flow from within the enclosure to the surrounding environment.

It is desirable to have substantial amounts of sorbent foam material within the enclosure and spread throughout the enclosure. At a reasonable minimum, it is desired to have at least about 0.1 g sorbent material per $ft^3$ of enclosure air space. This is about 3.5 $g/m^3$. It is preferred to have at least about 13.0 $gm/m^3$ and more preferred to have at least 25.0 $g/m^3$ sorbent material to air space within the enclosure.

The thermoset foams which are useful in accordance with the invention are described in detail in the abovementioned copending U.S. patent applications Ser. Nos. 469,102 and 471,579. As described in application Ser. No. 469,102 the black sorbent thermoset foams are prepared by pyrolysis of a liquid composition comprising at least one aromatic nitrogen-containing compound, the thermoset foam being non-carcinogenic or otherwise toxic to humans and substantially free from low molecular weight fusible toxic components and so being capable of being safely handled by man. Also as described in that application the black thermoset foam may be one which is prepared by pyrolysis of a liquid composition comprising at least one aromatic nitrogen-containing compound, the thermoset foam having a specific surface area of at least 50 $meters^2$ per gram. As described in application Ser. No. 471,579 the black sorbent foam can have a very high specific surface area and can be prepared by pyrolysing a liquid mixture of at least one aromatic nitrogen-containing compound and a Lewis acid metallic salt followed by removal of the Lewis acid metallic salt. These black sorbent thermoset foams are believed to have a poly-quinoxaline structure and so it appears that they have the general repeating structure:

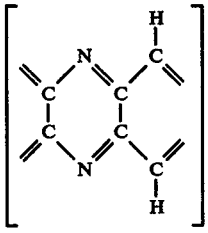

with cross-linking between the chains of these repeating fused aromatic rings, the positions of the cross-links being from the carbon atoms to which the hydrogen atoms are attached after removal of the latter. This structure makes the thermoset foam very stable both to heat and oxidation. Thus a piece of the foam can be held in a flame and, while it will glow and gradually burn away, it will stop burning immediately when it is removed from the flame and is not apparently decomposed by this treatment. This structure is consistent with the black colour of the foam and with the elementary analysis of the foam which gives a nitrogen content in the range of about 12 to 20%.

In this foam structure it appears that the nitrogen atoms impart the chemisorption properties. In addition to this, the foam may, depending upon its manner of preparation, contain some functional groups.

The aromatic nitrogen-containing compound is pyrolysed by heating it to a relatively low temperature, e.g., around 200° C, but once pyrolysis starts, an exothermic reaction occurs and it appears that the temperature of the overall mass may increase to a temperature of the order of 300° C. Within this mass there may be, however, localised regions where the temperature is much higher. Once the exothermic reaction starts no further external heating is required, the heating to pyrolysis temperature being merely to initiate the reaction.

When reaction occurs there is a quite sudden and large expansion to give a sponge of the thermoset foam which may have an apparent volume many hundreds of times the initial volume. Therefore, unless careful steps are taken to ensure that the pyrolysis temperature is maintained or the thermoset foam is purified, the foam will contain unreacted material and low molecular weight condensed fusible species which are carcinogenic or otherwise toxic to humans if the foam is handled.

In order to ensure that the thermoset foam be non-carcinogenic or otherwise non-toxic, i.e., contains no more than traces of starting material or low molecular weight fusible species, e.g. no more than 0.001% by weight of either, and even residual traces such as these are usually included within the body of the foam and therefore precluded from contact when the foam is handled, it can be prepared in the pure state if substantially complete pyrolysis is ensured by enclosing the material during reaction so that in spite of the sudden and large increase in apparent volume the reacting material is maintained at the pyrolysis temperature after formation or by exhaustively purifying it as prepared with dilute acids, water, dilute bases, water and organic solvents. If required one can both exhaustively purify and reheat the thermoset foam to at least its pyrolysis temperature.

The black thermoset foams are prepared by pyrolysis of a liquid composition to give the solid foam and not by charring of a carbonaceous solid to give a solid char. Thus, the pore structure of the foams becomes formed during the pyrolysis reaction and is not already present in the material being pyrolysed. In effect a condensation reaction appears to occur during the pyrolysis and so the aromatic nitrogen-containing compound should have a structure which readily condenses or the liquid mixture which is pyrolysed should contain in addition to the aromatic nitrogen-containing compound one or more compounds which promote the condensation of the aromatic nitrogen-containing compound, e.g., because they are dehydrating agents for and/or co-condense with, the aromatic nitrogen-containing compound.

There are a large number of ways in which the liquid composition containing the aromatic nitrogen-containing compound can be pyrolysed. Thus an aromatic nitrogen-containing compound which is liquid at the pyrolysis temperature, can be pyrolysed on its own or in admixture with other components to give a liquid mixture at the pyrolysis temperature, i.e., a mixture which is composed of liquid components or a solution of one or more components in the other or others. These other components are, as noted above, chosen to promote the condensation of the aromatic nitrogen-containing compound. As noted above one group of compounds which promote this condensation are believed to be dehydrating agents for the aromatic nitrogen-containing compound and assist in forming cross-links in the foam structure since we believe this tends to define the desired pore structure in the thermoset foams of the invention at an early stage in the pyrolysis of the aromatic nitrogen-containing compound.

Examples of suitable strong acids are mineral acids such as sulphuric acid and phosphoric acid or organic acids such as methane sulphonic acid or fluorinated methane sulphonic acid, while examples of strong bases are the mineral bases such as sodium and potassium hydroxide. One can of course employ latent acids, i.e., compounds which readily decompose on heating to give strong acids and examples are amine salts of strong acids such as $(CH_3)_3NSO_3$, and $CH_2CBr_3$.

The aromatic nitrogen-containing compound can also be pyrolysed in admixture with an organic acid such as oxalic acid or adipic acid which appear to co-condense with the aromatic nitrogen-containing compound and may in some instances give foams of increased specific surface area. When they are used, however, it appears to be desirable additionally to include a strong acid in the liquid mixture which is pyrolysed.

The aromatic nitrogen-containing compound can further be pyrolysed in admixture with a soluble salt, preferably in the additional presence of a strong acid or base and examples of suitable soluble salts are sodium sulphate, sodium chloride, sodium bisulphate and primary sodium phosphate. It is believed that these soluble salts act rather like a filler forming layers or pores between condensed reacted molecules during the pyrolysis to assist in defining the structures required in a molecular scale. Thereafter, removal of these salts, e.g., by leaching leaves the required pore structure.

The aromatic nitrogen-containing compound can be pyrolysed with a Lewis acid metallic salt as described in U.S. application Ser. No. 471,579 when foam of specific surface area of over 100 $m^2/g$ and often as high as 900 $m^2/g$ or even higher can be prepared.

We believe that the Lewis acid metallic salts should be capable of coordinating with amine groups and examples include aluminum chloride and ferric chloride, and the more expensive boron trifluoride, silicon tetrachloride, titanium tetrachloride, tin tetrachloride and germanium tetrachloride. The preferred Lewis acid metallic salt is, however, zinc chloride which currently appears to give the highest specific surface areas.

Although we are not certain we believe the Lewis acid metallic salt may also act rather like a filler forming layers between condensed reacted molecules during the pyrolysis to assist in defining the foam structure required on a molecular scale. Thereafter removal of the salt leaves the required pores giving the thermoset foams of the invention their high specific surface areas. In addition the Lewis acid metallic salts may have a corrosive action upon the thermoset foams so forming additional voids or pores.

When the mixture of aromatic nitrogen-containing compound and Lewis acid metallic salt is heated to pyrolysis temperature, a sudden and vigorous reaction occurs with the formation of a voluminous black sponge of the foam. These sponges can then be crushed to give a powder which destroys the large voids in the sponges and the Lewis acid metallic salt leached or otherwise removed from the powder or sponge to leave a black thermoset foam according to the invention having a microporous structure. The removal of the Lewis acid metallic salts can be readily achieved by washing the foam with dilute acid followed by water. In addition the foam can thereafter be exhaustively purified by washing with a dilute base, water, and an organic solvent.

The pyrolysis can be effected by heating the reaction mixture to a relatively low temperature, e.g., around 200° C, but once pyrolysis starts an exothermic reaction occurs as described above.

The specific surface area of the foam used according to the invention depends upon the aromatic nitrogen-containing compound or mixture of that compound and other compounds but in cases other than those described in U.S. application Ser. No. 471,579 until after the Lewis acid metallic salt catalyst has been removed from the foam, the specific surface area can be increased by further pyrolysis, e.g., at a temperature of 300° to 800° C of the thermoset foam under a controlled atmosphere, e.g., a nitrogen atmosphere which may be saturated with steam. During this further pyrolysis weight loss occurs but specific area increases.

The larger the surface area the larger the quantity of material which can be sorbed and so the greater the affinity of the foam for silver tarnishing components. Therefore the foams used according to the present invention preferably have a very high surface area. The pure non-carcinogenic and non-toxic thermoset foam preferably has a specific surface area of at least $50m^2/g$ and the specific surface area of the foams can be at least $200m^2/g$ and as high as $900m^2/g$.

The large and sudden increase in volume which occurs upon pyrolysis to give the thermoset foam occurs as a result of the release of steam and other volatile materials during the reaction. The result is a sponge having large voids. These do not contribute significantly to the specific surface area, which is a measure of the microporous structure of the foams. This specific area can be measured by standard BET methods as described by Brunauer, Emmett and Teller in the Journal of the American Chemical Society, 60 page 309 (1938). We believe that it is in the pores of this microporous thermoset foam that polar molecules are chemically sorbed and so the higher the specific surface area the larger the sorptive capacity of the foam.

The aromatic nitrogen-containing material can be any aromatic compound containing a nitrogen atom as part of a substituent of the aromatic structure or containing nitrogen atoms both as part of the aromatic structure and as part of a substituent on the aromatic structure. It appears that the aromatic nitrogen-containing compound should be one which contains at least one nitro-group together with an amino and/or hydroxyl group and/or other groups such as:

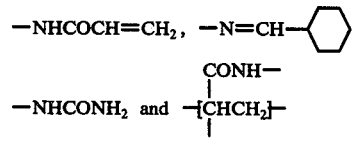

which appear to be precursors for amine groups. Such compounds include heterocyclic aromatic compounds containing additional nitrogen atoms within the aromatic ring or rings and multicyclic aromatic compounds. It is preferred that the amino or hydroxyl group be in the ortho or para positions relative to the nitro group.

Preferred aromatic nitrogen-containing starting compounds include, for example, p-nitroacetanilide, 2-nitroaniline, 4-nitroaniline, amino-nitro-toluenes, aminonitroxylenes, 2,6-dibromo- or chloro-4-nitroaniline, 4-nitrophenylhydrazine, bis-(2-nitrophenyl urea), and nitronaphthyl amines having vacant positions ortho to the nitro and amino groups or mixtures of any of these starting compounds.

Although the aromatic nitrogen-containing compound can be pyrolysed on its own, it is preferred that a mixture of it and an acid such as sulphuric acid or phosphoric acid or a mixture of an organic acid such as oxalic acid with a mineral acid, or a mixture of a strong acid and an excess of a salt such as sodium sulphate, or a strong base such as sodium hydroxide or potassium hydroxide or a mixture of it with a Lewis acid metallic salt, be pyrolysed. Such mixtures are usually pasty liquids at room temperature and, as they are slowly brought up to the pyrolysis temperature, a homogeneous solution forms. Then suddenly the vigorous reaction occurs with copious evolution of gases, believed to be mainly steam, and a voluminous black sponge of the thermoset foam is formed.

This manner of preparation often tends to give thermoset foams which have, as prepared, relatively low specific surface areas, e.g., when pyrolysis is effected in the presence of sulphuric acid, but which can be given increased specific surface areas by, for example, further pyrolysis as noted above. When the pyrolysis is effected in the presence of phosphoric acid, the foams often have quite high specific surface.

Once the voluminous black sponge has been formed it can be crushed to give a powder of the thermoset foam. This destroys the large voids in the sponge but retains the specific surface area which is constituted by the microporous structure of the foam. Where a salt such as a Lewis acid metallic salt is present this might be removed before the microporous structure of the foam is given. The foam powder can then be used or alternatively treated to purify it from carcinogenic materials or other toxic components or simply to increase its specific surface area.

To purify the thermoset foam, it can be powdered and the powder washed successively with an acid, e.g., dilute HCl or base, e.g., dilute NaOH and an organic solvent such as acetone. Between each washing the powder can be recovered by filtration and washed with water. In this way all traces of starting materials and low molecular weight fusible species can be removed. alternatively or in addition the thermoset foam powder can be further pyrolysed under higher temperatures, e.g., 400° C, and an inert atmosphere, e.g., a nitrogen atmosphere. This also tends to increase specific surface area of the foam.

In order to demonstrate the efficiency of the sorbent foams in preventing corrosion or tarnishing of silver the following experiment was performed.

Silver sheet was carefully polished with rouge, washed with detergent solution and degreased with chloroform. Small specimens (1.5 cm square) were cut from this sheet and placed within air-filled glass flasks of approximate volume 800 ml. Polyquinoxaline foam sorbent (60 mg pellets) was positioned locally in two of the flasks and then hydrogen sulphide (10 micro liters) was added from a syringe. Within ½ hour the unprotected specimens were distinctly yellow and after 2 days this colour had changed to dark blue. However, even after 2 months the protected specimens were bright and free from tarnish.

A more detailed example is shown below.

EXAMPLE

Black sorbent foam material was made in accordance with U.S. patent application Ser. No. 471,579.

The foam had a specific surface area of 730 $m^2/g$ and was loaded into paper carrier sheet in the following fashion. The foam was slurried in the requisite amounts (10 and 33% by weight of paper) with semi-bleached Kraft softwood pulp, collected on a wire mesh filter from water, then pressed and dried according to conventional papermaking practice.

Sections of silver sheet 2 cm square were cleaned according to ASTM D2043 using mild abrasive powder.

A silverware display case having dimensions of 30.5 × 30.5 × 15.2 cm was used as the enclosure. $H_2S$ was added to the enclosure by gas syringe at intervals of not less than 3 hours. The $H_2S$ was added in an amount sufficient to make the concentration within the enclosure 1 p.p.m. This is an extremely high concentration of atmospheric $H_2S$ as can be noted from the fact that the recognized toxic level of $H_2S$ begins at about 10 p.p.m., and relatively high atmospheric concentrations of $H_2S$ are measured in parts per hundred million.

The results appear in the following table

| SAMPLE | WT. OF FOAM SORBENT (g) | ALIQUOTS OF $H_2S$ ADDED | SILVER CONDITION |
|---|---|---|---|
| Control | None | 1 | brown-black at 3 hrs.* |
| 1 | 0.139 | 3 | brown-blue at 9 hrs.* |
| 2 | 0.418 | 13 | yellow at 39 hrs.* |
| 3 | 1.380 | 24 | very slightly yellow at 72 hrs.* |

*only 3 aliquots injected per day. Time indicated merely provides convenient reference for comparison.

The dramatic reduction in corrosion of the silver can be seen from the above data. Similar experiments have been run with copper and steel with hydrogen sulfide and hydrochloric acid environments, respectively. This method of protection is also useful for metals such as Cd, Ni, Zn, Sn and Fe.

What is claimed is:

1. A method for the protection of metal items which are susceptible to corrosion by acid vapors which comprises confining said metal item within an enclosure which does not allow free flow of gas from the enclosure to the environment and further including within the enclosure a black sorbent thermoset foam material made by the pyrolysis of a composition liquid at the pyrolysis temperature said composition comprising at least one aromatic nitrogen containing compound having the formula:

$$X - Ar - Y$$

wherein Ar represents an aromatic nucleus, X represents a substituent having a negative Hammett sigma constant and attached to the aromatic nucleus by a nitrogen, oxygen, or sulfur atom which forms a part of said X substituent, and Y represents a substituent having a positive Hammett sigma constant and attached to the aromatic nucleus by a nitrogen atom which forms a part of said Y substituent, the substituents X and Y being either directly attached to the aromatic nucleus or directly attached to a ring fused to the aromatic nucleus, the sorbent thermoset form having a specific surface area of at least 50 $m^2/g$, and said pyrolysis comprising heating said composition to initiate reaction of the said composition.

2. The method of claim 1 wherein said metal items are selected from metal coated items, metal containing items, and solid metal items.

3. The method of claim 2 wherein said metal of said metal items is selected from silver, copper, and lead.

4. The method of claim 3 wherein said metal is silver.

5. The method of claim 1 wherein the enclosure will not permit replacement of air within the enclosure at a rate greater than 20 times per day under stable conditions.

6. The method of claim 1 wherein the black sorbent foam is present within the enclosure in a ratio of foam to gas volume within the enclosure of at least 3.5 $g/m^3$.

7. An enclosure for the protection of metal items which are susceptible to corrosion by acid vapors comprising a structure which confines gas sufficiently so as to not allow free flow of gas from the enclosure to the environment under stable conditions, said enclosure containing a black sorbent thermoset foam material made by the pyrolysis of a composition liquid at the pyrolysis temperature said composition comprising at least one aromatic nitrogen containing compound having the formula:

$$X - Ar - Y$$

wherein Ar represents an aromatic nucleus, X represents a substituent having a negative Hammett sigma constant and attached to the aromatic nucleus by a nitrogen, oxygen, or sulfur atom which forms a part of said X substituent, and Y represents a substituent having a positive Hammett sigma constant and attached to the aromatic nucleus by a nitrogen atom which forms a part of said Y substituent, the substituents X and Y being either directly attached to the aromatic nucleus, or directly attached to a ring fused to the aromatic nucleus, the sorbent thermoset foam having a specific surface area of at least 50 $m^2/g$, and said pyrolysis comprising heating said composition to initiate reaction of the said composition.

8. The enclosure of claim 7 further containing at least one of silver, copper, or lead which is to be protected from corrosion.

9. The enclosure of claim 7 further containing silver which is to be protected from corrosion.

10. The enclosure of claim 7 wherein the enclosure will not permit replacement of air within the enclosure at a rate greater than 20 times per day under stable conditions.

11. The enclosure of claim 7 wherein the enclosure contains said black sorbent foam material in a ratio of foam to volume of gas within the enclosure of at least 3.5 $g/m^3$.

12. The method of claim 1 wherein X and Y are directly attached to said aromatic nucleus.

13. The enclosure of claim 7 wherein X and Y are directly attached to said aromatic nucleus.

* * * * *